US008263311B2

(12) United States Patent
Shiraishi

(10) Patent No.: US 8,263,311 B2
(45) Date of Patent: Sep. 11, 2012

(54) PHOTOSENSITIVE LITHOGRAPHIC PRINTING PLATE PRECURSOR FOR INFRARED LASER

(75) Inventor: Yuichi Shiraishi, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 407 days.

(21) Appl. No.: 12/555,030

(22) Filed: Sep. 8, 2009

(65) Prior Publication Data

US 2010/0062367 A1 Mar. 11, 2010

(30) Foreign Application Priority Data

Sep. 9, 2008 (JP) ..... 2008-231453

(51) Int. Cl.
*B41C 1/10* (2006.01)

(52) U.S. Cl. ..... 430/271.1; 430/302; 430/273.1; 101/457

(58) Field of Classification Search ..... None
See application file for complete search history.

(56) References Cited

U.S. PATENT DOCUMENTS

| | | | | |
|---|---|---|---|---|
| 3,280,189 | A * | 10/1966 | Cline, Jr. | 564/208 |
| 7,144,661 | B1 * | 12/2006 | Ray et al. | 430/15 |
| 2004/0067432 | A1 | 4/2004 | Kitson et al. | |
| 2005/0037280 | A1 | 2/2005 | Loccufier et al. | |
| 2005/0037292 | A1 | 2/2005 | Kitson et al. | |

FOREIGN PATENT DOCUMENTS

| | | | |
|---|---|---|---|
| JP | 2005-62875 | A | 3/2005 |
| WO | WO 2007/084284 | A1 | 7/2007 |

OTHER PUBLICATIONS

Extended European Search Report issued on Feb. 6, 2012 in corresponding European Patent Application No. 09169312.7.

* cited by examiner

*Primary Examiner* — Cynthia Hamilton
(74) *Attorney, Agent, or Firm* — Birch, Stewart, Kolasch & Birch, LLP

(57) ABSTRACT

A photosensitive lithographic printing plate precursor for infrared laser includes in the following order: a support having a hydrophilic surface; a lower layer containing a polymer compound having at least a unit derived from a polymerizable monomer represented by the following formula (I); and an upper layer containing a polymer compound having a group represented by the following formula (II) in a side chain, (I)

wherein $R^1$ represents a hydrogen atom or a methyl group, $R^2$ represents a methylene group or an ethylene group, $R^3$ represents a methyl group, and X represents O or NH, (II)

wherein $Z^1$, $Z^2$ and $Z^3$ each independently represents a hydrogen atom or a monovalent substituent composed of at least one nonmetallic atom.

10 Claims, No Drawings

PHOTOSENSITIVE LITHOGRAPHIC PRINTING PLATE PRECURSOR FOR INFRARED LASER

FIELD OF THE INVENTION

The present invention relates to a photosensitive lithographic printing plate precursor for infrared laser, more particularly, to a photosensitive lithographic printing plate precursor for infrared laser capable of undergoing so-called direct plate making, in which the plate making is directly conducted by scanning of infrared laser beam based on digital signals, for example, from a computer.

BACKGROUND OF THE INVENTION

The progress of laser in recent years has been remarkable and a high output and particularly, compact solid laser or semiconductor laser having a light emission region in the range from near infrared to infrared becomes easily available. These lasers are extremely useful as light sources for exposure in conducting the direct plate making from digital data of a computer or the like.

A photosensitive lithographic printing plate precursor for infrared laser to which infrared laser having a light emission region in the infrared region is used as the light source for exposure is a lithographic printing plate precursor containing, as essential components, a binder resin and an IR dye which absorbs light to generate heat. When the lithographic printing plate precursor for infrared laser having a positive-working photosensitive layer is exposed to infrared laser, in the unexposed area (image area) the IR dye in the lithographic printing plate precursor for infrared laser interacts with the binder resin to act as a dissolution inhibiting agent which substantially decreases the solubility of the binder resin. On the other hand, in the exposed area (non-image area), the IR dye absorbs light to generate heat and as a result, the interaction between the IR dye and the binder resin is weakened. Thus, during development, the exposed area (non-image area) is dissolved in an alkali developer to form a lithographic printing plate.

Such lithographic printing plate precursor for infrared lasers still have various problems. One of the problems is how to improve resistance to various chemicals for printing. When the chemical resistance of the surface is low, due to splash of the chemicals at the printing or residue of the chemicals used after wipe the image area changes in quality or dissolves to cause undesirably a problem in that printing ink becomes incapable of adhering during the printing. Another problem is how to improve scratch resistance of the surface. When the scratch resistance of the surface is low, the surface is rubbed with a member being touch with the surface during automatically performing exposure or development to cause scratch, whereby a problem of abrasion of the image area undesirably occur.

Various investigations have been made to overcome these problems. For instance, a technique of forming a recording layer containing an alkali-soluble resin having excellent chemical resistance is proposed (see, for example, JP-A-2005-62875 (the term "JP-A" as used herein means an "unexamined published Japanese patent application") (corresponding to US2005/0037280 A1)). However, although the improvement in chemical resistance of the recording layer is recognized, circumference of a small scratch formed before development is dissolved at the development to cause a problem of occurrence of white spot in the image area.

Further, it is believed that two or more layer construction of the resin layer of lithographic printing plate is useful for achieving both the chemical resistance and the scratch resistance and, for example, use of a polymer compound containing as a constituting unit, a maleimide compound in a lower layer is proposed (see, for example, US2004/0067432 A1). However, adhesion of the lower layer to an upper layer is not necessarily sufficient and further improvements have been requested.

SUMMARY OF THE INVENTION

An object of the present invention is to provide a photosensitive lithographic printing plate precursor for infrared laser which is excellent in the chemical resistance and scratch resistance of the image area, which has good developing property and which exhibits significant improvement in printing durability when it is subjected to heat treatment at high temperature after development.

As a result of intensive investigations, the inventor has found that the above-described object can be achieved by a photosensitive lithographic printing plate precursor for infrared laser (hereinafter, also referred to as a "lithographic printing plate precursor" or a "photosensitive lithographic printing plate") describe hereinafter.

Specifically, the present invention includes a photosensitive lithographic printing plate precursor for infrared laser comprising a support having a hydrophilic surface, a lower layer containing a polymer compound having at least a unit derived from a polymerizable monomer represented by formula (I) shown below and an upper layer containing a polymer compound having a group represented by formula (II) shown below in its side chain in this order:

(I)

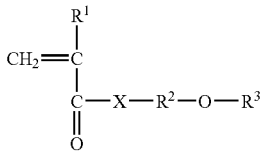

In formula (I), $R^1$ represents a hydrogen atom or a methyl group, $R^2$ represents a methylene group or an ethylene group, $R^3$ represents a methyl group, and X represents O or NH;

(II)

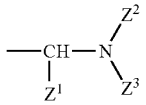

In formula (II), $Z^1$, $Z^2$ and $Z^3$ each independently represents a hydrogen atom or a monovalent substituent composed of at least one nonmetallic atom.

The terminology "provided in this order" means at least the lower layer and upper layer are provided on the hydrophilic surface of the support in this order and the presence of other layer optionally provided, for example, au undercoat layer, a protective layer or a backcoat layer should not be denied.

The lithographic printing plate precursor according to the invention is excellent in the chemical resistance and scratch resistance of the image area, has good developing property and development latitude, and can exhibit significant improvement in printing durability when it is subjected to heat treatment at high temperature after development by incorporating two kinds of specific polymer compounds in the lower layer and upper layer, respectively. The reason for this is believed to be as follows, although it is not quite clear. Specifically, the overall chemical resistance of lithographic printing plate is improved by using the polymer compound excellent in the chemical resistance in both the lower layer and upper layer. Also, it is possible to control the scratch resistance of the upper layer by constructing a multilayer structure. Further, since the polymer compound used in the lower layer is able to undergoing a crosslinking reaction with heat and exhibits good crosslinking efficiency with a specific group of the polymer compound used in the upper layer as a reaction counterpart, the printing durability is significantly improved when the lithographic printing plate is subjected to heat treatment at high temperature after development.

According to the present invention, a photosensitive lithographic printing plate precursor for infrared laser which is excellent in the chemical resistance and scratch resistance of the image area, which has good developing property, which is able to provide good printed material and which exhibits significant improvement in printing durability when it is subjected to heat treatment at high temperature after development can be provided.

DETAILED DESCRIPTION OF THE INVENTION

The photosensitive lithographic printing plate precursor for infrared laser according to the invention comprises a support having a hydrophilic surface, a lower layer containing a polymer compound having at least a unit derived from a polymerizable monomer represented by formula (I) shown above and an upper layer containing a polymer compound having a group represented by formula (II) shown above in its side chain in this order.

Each component will be described in order below.

The polymer compound (hereinafter, also referred to as a "polymer compound (I)") having at least a unit derived from a polymerizable monomer (hereinafter, also referred to as a "polymerizable monomer (I)" or a "compound (I)") represented by formula (I), which is incorporated into the lower layer of the lithographic printing plate precursor according to the invention, is described below.

In formula (I), $R^1$ represents a hydrogen atom or a methyl group, $R^2$ represents a methylene group or an ethylene group, $R^3$ represents a methyl group, and X represents O or NH.

$R^1$ is preferably a hydrogen atom and $R^2$ is preferably a methylene group.

The polymer compound (I) may be a polymer composed of only the polymerizable monomer (I) or a copolymer of the polymerizable monomer (I) and other copolymerizable monomer. From the standpoint of appropriately imparting desirable characteristics or the like, a copolymer of the polymerizable monomer (I) and other copolymerizable monomer is preferable.

As the other copolymerizable monomer, a monomer having an acid group is preferable.

The monomer having an acid group is not particularly restricted and includes, for example, monomers having an acid group represented by any one of (1) to (6) shown below.

(1) a phenol group (—Ar—OH)
(2) a sulfonamido group ($—SO_2NH—R$)
(3) an acid group of a substituted sulfonamido type (hereinafter also referred to as an "active imido group") ($—SO_2NHCOR$, $—SO_2NHSO_2R$ or $—CONHSO_2R$)
(4) a carboxylic acid group ($—CO_2H$)
(5) a sulfonic acid group ($—SO_3H$)
(6) a phosphoric acid group ($—OPO_3H_2$)

In the acid groups (1) to (6) described above, Ar represents a divalent aryl connecting group which may have a substituent, and R represents a hydrocarbon group which may have a substituent.

Examples of the monomer having the acid group selected from the acid groups (1) to (6) described above include the followings.

(1) Examples of the monomer having a phenol group include an acrylamide, methacrylamide, acrylate and methacrylate each having a phenol group and hydroxystyrene.
(2) Examples of the monomer having a sulfonamido group include compounds having at least one sulfonamido group wherein at least one hydrogen atom is bonded to the nitrogen atom and at least one polymerizable unsaturated group in the molecules thereof. Among them, low-molecular compounds having both an acryloyl group, an allyl group or a vinyloxy group and a unsubstituted or mono-substituted aminosulfonyl group or a substituted sulfonylimino group in the molecules thereof are preferred. Examples of such low-molecular compounds include compounds represented by the following formulae (i) to (v).

(i)

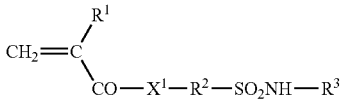

(ii)

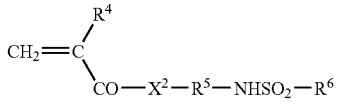

(iii)

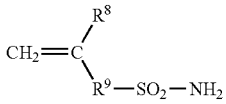

(iv)

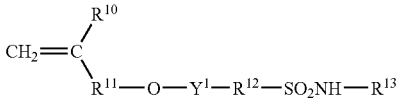

(v)

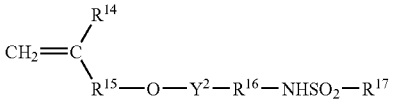

In formulae (i) to (v), $X^1$ and $X^2$ each independently represents —O— or $—NR^7—$. $R^1$ and $R^4$ each independently represents a hydrogen atom or $—CH_3$. $R^2$, $R^5$, $R^9$, $R^{12}$ and $R^{16}$ each independently represents an alkylene group having from 1 to 12 carbon atoms, a cycloalkylene group, an arylene group or an aralkylene group. $R^3$, $R^7$ and $R^{13}$ each independently represents a hydrogen atom or an alkyl group having from 1 to 12 carbon atoms, a cycloalkyl group, an aryl group or an aralkyl group. $R^6$ and $R^{17}$ each independently represents an alkyl group having from 1 to 12 carbon atoms, a cycloalkyl group, an aryl group or an aralkyl group. $R^8$, $R^{10}$ and $R^{14}$ each independently represents a hydrogen atom or $CH_3$. $R^{11}$ and $R^{15}$ each independently represents a single bond or an alkylene group having from 1 to 12 carbon atoms, a cycloalkylene group, an arylene group or an aralkylene group. $Y^1$ and $Y^2$ each independently represents a single bond or $—C(=O)—$. The above-described alkylene group, cycloalkylene group, arylene group, aralkylene group, alkyl group, cycloalkyl group, aryl group or an aralkyl group may have a substituent. Preferable example of the substituent include an alkyl group.

Particularly, of the compounds represented by formulae (i) to (v), for example, m-aminosulfonylphenyl methacrylate, N-(p-aminosulfonylphenyl)methacrylamide and N-(p-aminosulfonylphenyl)acrylamide are preferably used in the lithographic printing plate precursor according to the invention.

(3) Examples of the monomer having an active imido group include compounds having at least one active imido group represented by the structural formula shown below and at least one polymerizable unsaturated group in the molecule thereof.

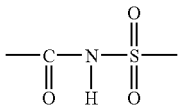

Specifically, for example, N-(p-toluenesulfonyl)methacrylamide and N-(p-toluenesulfonyl)acrylamide are preferably used.

(4) Examples of the monomer having a carboxylic acid group include compounds having at least one carboxylic acid group and at least one polymerizable unsaturated group in the molecule thereof. Particularly, acrylic acid, methacrylic acid, maleic acid and itaconic acid are preferably used in the lithographic printing plate precursor according to the invention.

(5) Examples of the monomer having a sulfonic acid group include compounds having at least one sulfonic acid group and at least one polymerizable unsaturated group in the molecule thereof.

(6) Examples of the monomer having a phosphoric acid group include compounds having at least one phosphoric acid group and at least one polymerizable unsaturated group in the molecule thereof.

In the lithographic printing plate precursor according to the invention, a monomer having a carboxylic acid is preferably used and methacrylic acid is particularly preferably used.

Further, the polymer compound (I) may be a copolymer of the polymerizable monomer (I), a monomer having an acid group and appropriate other polymerizable monomer. The other monomer is not particularly restricted as long as it is a monomer copolymerizable with monomer components constituting the polymer compound (I) and includes, for example, a (meth)acrylate, (meth)acrylonitrile, a styrene compound and a maleimide.

The content of the component derived from the polymerizable monomer (I) in the polymer compound (I) is not particularly restricted and is preferably from 5 to 95% by mole, more preferably from 10 to 90% by mole. The content of the component derived from the polymerizable monomer having an acid group is also not particularly restricted and is preferably from 1 to 90% by mole, more preferably from 10 to 70% by mole. When the component derived from other copolymerizable monomer is present, the content thereof is also not particularly restricted and is preferably from 1 to 70% by mole.

The synthesis method of the polymer compound (I) is not particularly restricted and widely known radical polymerization methods can be used.

The molecular weight of the polymer compound (I) is not particularly restricted and is preferably from 5,000 to 500,000, more preferably from 8,000 to 300,000, in terms of weight average molecular weight.

Preferable examples of the copolymer are set forth below.

(1) N-Methoxymethylmethacrylamide/methacrylic acid/acrylonitrile (40/30/30 in molar ratio) copolymer having weight average molecular weight of 60,000

(2) N-Methoxymethylmethacrylamide/methacrylic acid/benzyl methacrylate (50/25/25 in molar ratio) copolymer having weight average molecular weight of 70,000

(3) N-Methoxyethylmethacrylamide/methacrylic acid/N-phenyl maleimide (65/20/15 in molar ratio) copolymer having weight average molecular weight of 40,000

(4) N-Methoxyethylmethacrylamide/4-hydroxyphenylmethacrylamide/acrylonitrile (30/25/45 in molar ratio) copolymer having weight average molecular weight of 50,000

(5) Methoxymethyl methacrylate/methacrylic acid/p-hydroxystyrene/acrylonitrile (40/20/5/35 in molar ratio) copolymer having weight average molecular weight of 70,000

(6) Methoxymethyl methacrylate/methacrylic acid/N-phenylmaleimide/acrylonitrile (25/25/10/40 in molar ratio) copolymer having weight average molecular weight of 70,000

The amount of the polymer compound (I) added to the lower layer is not particularly restricted and is preferably from 10 to 99% by weight, more preferably from 20 to 95% by weight, particularly preferably from 30 to 90% by weight, based on the total solid content of the lower layer. When the amount of the polymer compound (I) added is in the range described above, it is preferred because the chemical resistance is excellent and the heat crosslinking efficiency becomes high.

The polymer compound (hereinafter, also referred to as a "polymer compound (II)") having a group represented by formula (II) in its side chain, which is incorporated into the upper layer of the lithographic printing plate precursor according to the invention, is described below.

In formula (II), $Z^1$, $Z^2$ and $Z^3$ each independently represents a hydrogen atom or a monovalent substituent composed of at least one nonmetallic atom.

The monovalent substituent composed of at least one nonmetallic atom represented by $Z^1$, $Z^2$ or $Z^3$ is preferably a substituent composed of a linking moiety and a terminal moiety. The linking moiety is used, if desired, and the monovalent substituent composed of at least one nonmetallic atom may be formed only from the terminal moiety described below.

Further, the monovalent substituent composed of at least one nonmetallic atom may be substituted, for example, with an alkyl group or an aryl group.

Examples of the linking moiety include an alkylene group, an alkenylene group, an arylene group, for example, a phenylene group or a naphthalene group, a heterocyclic group containing a hetero atom, for example, a pyridyl group, a pyrazyl group, a pyrimidyl group or a thiazoyl group, a $—(C_2H_4O)_n—$ group (n is 1 to 12), a $—(C_2H_4S)_n—$ group (n is 1 to 12), a $—Ph—NHSO_2—$ group and combinations of these groups.

Examples of the terminal moiety include a hydrogen atom, an alkyl group, an alkenyl group, a cycloalkyl group, a cycloalkenyl group, an unsaturated cyclic hydrocarbon group, an aryl group, a heterocyclic group, an aralkyl group, $—OR^1$, $—SR^1$, $—COOR^1$, $—O—COR^1$, $—CO—R^2$, $—SO_3—R^1$, $—SO_2—R^1$, —CN, $—NO_2$, a halogen atom, a phosphate group, a phosphonate group, a tert-amino group, an amido group, an imido group and a sulfonamido group, wherein $R^1$ and $R^2$ each represents a hydrogen atom, a halogen atom, an alkyl group, an alkenyl group, a cycloalkyl group, a cycloalkenyl group, an unsaturated cyclic hydrocarbon group, an aryl group, a heterocyclic group, an aralkyl group and an amino group.

The hydrophobic aminoalkyl group as described above is preferably connected to a side chain of an alkali-soluble resin and a heretofore known alkali-soluble resin can be used as the alkali-soluble resin. It is preferred that the hydrophobic aminoalkyl group is connected to a side chain an alkali-soluble resin having a phenol structure in a repeating unit and more specifically it is connected to a phenyl ring of a phenol resin by a covalent bond.

Examples of preferable structure of the polymer compound (II) having a group represented by formula (II) in its side chain, which is incorporated into the upper layer of the lithographic printing plate precursor according to the invention, are set forth below, but the invention should not be construed as being limited thereto.

Formula (2) shown below indicates a preferable structure of the polymer compound (II) and substituents represented by R, $Z^1$, $Z^2$ and $Z^3$ in formula (2) are shown in Tables 1 to 3 below, respectively. The substituents represented by R, $Z^1$, $Z^2$ and $Z^3$ shown in Tables 1 to 3 can be appropriately combined with each other.

(2)

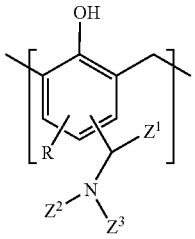

| | R |
|---|---|
| R-1 | —H |
| R-2 | —$CH_3$ |
| R-3 | —$C_2H_5$ |
| R-4 | —$C_3H_8$ |
| R-5 | —n-$C_4H_9$ |
| R-6 | —t-$C_4H_9$ |

| | $Z^1$ |
|---|---|
| $Z^1$-1 | —H |
| $Z^1$-2 | —$CH_3$ |
| $Z^1$-3 | 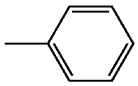 |
| $Z^1$-4 | —$C_2H_5$ |
| $Z^1$-5 | 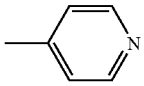 |
| $Z^1$-6 | —$C_3H_8$ |
| $Z^1$-7 | —$COOC_2H_5$ |
| $Z^1$-8 | 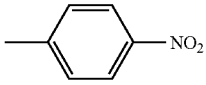 |
| $Z^1$-9 | 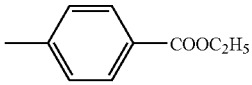 |
| $Z^1$-10 | 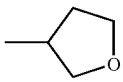 |
| $Z^1$-11 | 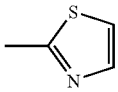 |

-continued
| | |
|---|---|
| $Z^1$-12 | 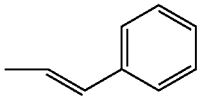 |
| $Z^1$-13 | 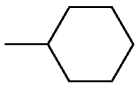 |
| $Z^1$-14 | 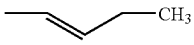 |
| $Z^1$-15 | 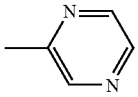 |
| $Z^1$-16 | 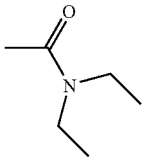 |
| $Z^1$-17 | 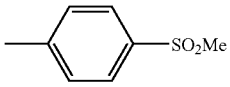 |
| $Z^1$-18 | 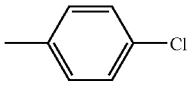 |
| $Z^1$-19 | 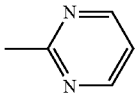 |
| $Z^1$-20 | 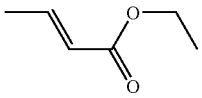 |
| | $Z^2$ | $Z^3$ |
|---|---|---|
| $Z^{23}$-1 | —H | —$C_2H_4OH$ |
| $Z^{23}$-2 | —H | 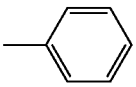 |
| $Z^{23}$-3 | —$CH_3$ | —$C_2H_4OH$ |
| $Z^{23}$-4 | —$CH_2$—CH═$CH_2$ | —$CH_2$—CH═$CH_2$ |
| $Z^{23}$-5 | —COOH | —COOH |
| $Z^{23}$-6 | —$CH_3$ | 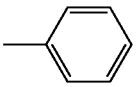 |
| $Z^{23}$-7 | —$CH_3$ | 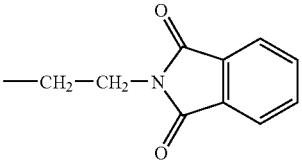 |
| $Z^{23}$-8 | —$CH_3$ | —$C_2H_4SO_2$—$CH_3$ |
| $Z^{23}$-9 | —$C_2H_4$—O—$C_2H_4$—O—$CH_3$ | —$C_2H_4$—O—$C_2H_4$—O—$CH_3$ |

-continued

| | | |
|---|---|---|
| $Z^{23}$-10 | —$CH_3$ | 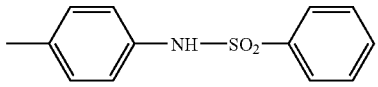 |
| $Z^{23}$-11 | —$CH_2$—CH—$CH_2$ | 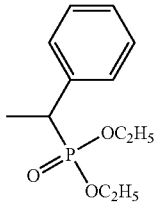 |
| $Z^{23}$-12 | —$C_2H_4OH$ | —$C_2H_4OH$ |
| $Z^{23}$-13 | —H | —$C_2H_4$—S—$C_2H_4OH$ |
| $Z^{23}$-14 | —H | —$(C_2H_4)$—O$)_3$—$C_2H_4OH$ |
| $Z^{23}$-15 | —$C_2H_4OH$ | —$C_2H_4OH$ |
| $Z^{23}$-16 | —H | 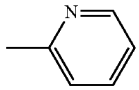 |
| $Z^{23}$-17 | —H | 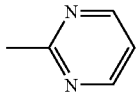 |
| $Z^{23}$-18 | —H | 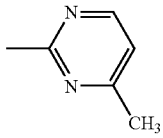 |
| $Z^{23}$-19 | —H | 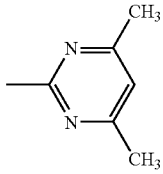 |
| $Z^{23}$-20 | —H | 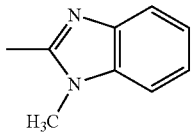 |

Specific examples (Compound Nos. 1 to 4) of the polymer compound (II) represented by formula (2) are set forth in Table 4 below, but the invention should not be construed as being limited thereto.

| Compound No. | R | $Z^1$ | $Z^2$ | $Z^3$ |
|---|---|---|---|---|
| 1 | —H | 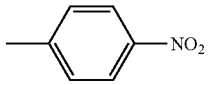 | —$C_2H_4$—O—$C_2H_4$—O—$CH_3$ | —$C_2H_4$—O—$C_2H_4$—O—$CH_3$ |
| 2 | —H | 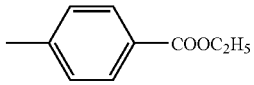 | —H | 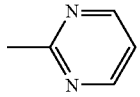 |

-continued

| Compound No. | R | $Z^1$ | $Z^2$ | $Z^3$ |
|---|---|---|---|---|
| 3 | $—CH_3$ | 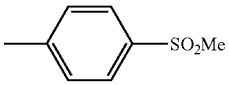 | $—CH_2—CH=CH_2$ | 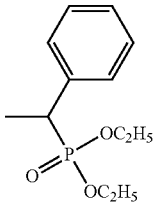 |
| 4 | $—C_2H_5$ | 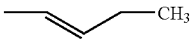 | —H | $—C_2H_4—S—C_2H_4OH$ |

Synthesis method of the polymer compound (II) is not particularly restricted. For instance, a phenol resin having a phenoxide substituent is subjected to reaction (nucleophilic addition reaction) with an isocyanate group using Sn metal as a catalyst to substitute a part of the substituents with a specific substituent, thereby preparing the polymer compound (II). The nucleophilic addition reaction between the phenoxide of a novolac-type phenol resin and an isocyanate group-containing compound can be conducted in the following manner. Specifically, the total amount of the novolac-type phenol resin for substituting a part of hydroxy groups thereof with the specific functional group is dissolved so as to have concentration of 20 to 80% by weight, preferably 30 to 70% by weight, in a solvent. To the solution is added an isocyanate group-containing compound in an amount sufficient for obtaining a desired molar ratio of the specific functional group based on the total molar amount of the hydroxy groups included in the novolac-type phenol resin. Then, Sn metal is added as a catalyst in an amount corresponding to a molar ratio of 0.5 to 5.0%, preferably 1.0 to 2.5, per the molar amount of the isocyanate group-containing compound under temperature condition of 10 to 200° C. and the mixture is stirred for several hours while maintaining the temperature. The reaction temperature is preferably from 20 to 150° C., and more preferably from 20 to 100° C. Examples of the solvent used in the reaction includes chloroform, dichloromethane, dimethylsulfoxide (DMSO), N,N-dimethylformamide (DMF), dimethyl ether (DME) and tetrahydrofuran (THF). Particularly, tetrahydrofuran is preferably used. As the Sn metal, dibutyltin dilaurate is preferably used.

With respect to a molecular weight of the polymer compound (II), a weight average molecular weight is preferably 2,00 or more, more preferably form 3,000 to 500,000, and a number average molecular weight is preferably 1,00 or more, more preferably form 2,000 to 400,000.

The amount of the polymer compound (II) added to the upper layer is not particularly restricted and is preferably from 10 to 99% by weight, more preferably from 20 to 95% by weight, particularly preferably from 30 to 90% by weight, based on the total solid content of the lower layer. It is preferred that the amount of the polymer compound (II) added is in the range described above because the chemical resistance and scratch resistance are excellent.

[Other Polymer Compound]

In the lower layer or upper layer of the lithographic printing plate precursor according to the invention, other polymer compound can be used together with the polymer compound described above. The other polymer compounds used together may be used individually or in combination of two or more thereof. When other polymer compounds are used in the lower layer and upper layer, it is preferred that the other polymer compounds are different from each other.

Other polymer compounds used are described below.

The other polymer compound which can be used in the invention is preferably a polymer compound soluble or swellable in an aqueous alkaline solution. Such polymer compounds include polymer compounds having the acid group selected from the acid groups (1) to (6) described above, which is contained in a preferable copolymerizable monomer for the polymer compound (I), in the main chain and/or side chain thereof.

The other polymer compounds having the acid group selected from the acid groups (1) to (6) include, for example, those shown below.

(1) Polymer compounds having a phenol group include, for example, novolac resins, xylenol resins and resol resins. Specific examples thereof include phenol formaldehyde resin, m-cresol formaldehyde resin, p-cresol formaldehyde resin, m-/p-mixed cresol formaldehyde resin, phenol/cresol (the cresol may be any of m-, p-, o-, m-/p-mixed, m-/o-mixed and o-/p-mixed) mixed formaldehyde resin, 1,2-xylenol resin, 1,3-xylenol resin, 1,4-xylenol resin, 1,5-xylenol resin, 2,3-xylenol resin, 2,4-xylenol resin, 2,5-xylenol resin, 2,6-xylenol resin, 3,4-xylenol resin, 3,5-xylenol resin, xylenol/phenol mixed resin, xylenol/novolac mixed resin, xylenol/novolac/phenol mixed resin and a condensation polymer of pyrogallol and acetone. Further, polymer compounds obtained by copolymerization of a compound having a phenolic group in its side chain are exemplified. Examples of such polymer compounds include polymer compounds containing as a copolymerization component, an acrylamide, a methacrylamide, an acrylate and a methacrylate each having a phenol group, or a hydroxystyrene.

(2) Polymer compounds having a sulfonamido group include, for example, polymers containing as the main constituting unit, a minimum constituting unit derived from a compound having a sulfonamido group. Examples of the compound having a sulfonamido group include the monomer having a sulfonamido group (2) described above, which is a preferable copolymerizable monomer for the polymer compound (I).

(3) Polymer compounds having an active imido group include, for example, polymers containing as the main constituting unit, a minimum constituting unit derived from a compound having an active imido group. Examples of the compound having an active imido group include the monomer having an active imido group (3) described above, which is a preferable copolymerizable monomer for the polymer compound (I).

(4) Polymer compounds having a carboxylic acid group include, for example, polymers containing as the main constituting unit, a minimum constituting unit derived from a compound having at least one carboxylic acid group and at least one polymerizable unsaturated group in its molecule. Examples of the compound having at least one carboxylic acid group and at least one polymerizable unsaturated group in the molecule thereof include the monomer having a carboxylic acid group (4) described above, which is a preferable copolymerizable monomer for the polymer compound (I).

(5) Polymer compounds having a sulfonic acid group include, for example, polymers containing as the main constituting unit, a minimum constituting unit derived from a compound having at least one sulfonic acid group and at least one polymerizable unsaturated group in its molecule.

(6) Polymer compounds having a phosphoric acid group include, for example, polymers containing as the main constituting unit, a minimum constituting unit derived from a compound having at least one phosphoric acid group and at least one polymerizable unsaturated group in its molecule.

In addition to the above-described polymer compounds, polymers obtained by using an unsaturated compound containing a urea bond as a connecting group and an acid group selected from the acid groups (1) to (6) in the side chain thereof are also used.

Of the polymer compounds having an acid group selected from the acid groups (1) to (6), polymer compounds having (1) phenol group, polymer compounds having (2) sulfonamido group, polymer compounds having (3) active imido group and polymer compounds having (4) carboxylic acid group are preferable and the polymer compounds having (1) phenol group, polymer compounds having (2) sulfonamido group and polymer compounds having (4) carboxylic acid group are particularly preferable.

It is not necessary to use only one kind of the minimum constituting units having the acid group selected from (1) to (6) described above and a copolymer obtained by copolymerization of two or more minimum constituting units having the same acid group or a copolymer obtained by copolymerization of two or more minimum constituting units having different acid groups may be used.

When the polymer compound is a copolymer, the content of the compound having the acid group selected from (1) to (6) for copolymerization is preferably 3% by mole or more, more preferably 5% by mole or more, in the copolymer. It is preferred that the content of the compound is 3% by mole or more because the solubility in alkaline developer substantially not containing an organic solvent becomes sufficient.

Examples of the monomer component copolymerized with the polymerizable monomer having the acid group described above include monomers illustrated in (m1) to (m11) shown below, but the invention should not be construed as being limited thereto.

(m1) acrylates and methacrylates each having an aliphatic hydroxy group, for example, 2-hydroxyethyl acrylate or 2-hydroxyethyl methacrylate;

(m2) alkyl acrylates, for example, methyl acrylate, ethyl acrylate, propyl acrylate, butyl acrylate, amyl acrylate, hexyl acrylate, octyl acrylate, benzyl acrylate, 2-chloroethyl acrylate or glycidyl acrylate;

(m3) alkyl methacrylates, for example, methyl methacrylate, ethyl methacrylate, propyl methacrylate, butyl methacrylate, amyl methacrylate, hexyl methacrylate, cyclohexyl methacrylate, benzyl methacrylate, 2-chloroethyl methacrylate or glycidyl methacrylate;

(m4) acrylamides and methacrylamides, for example, acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide or N-ethyl-N-phenylacrylamide;

(m5) vinyl ethers, for example, ethyl vinyl ether, 2-chloroethyl vinyl ether, hydroxyethyl vinyl ether, propyl vinyl ether, butyl vinyl ether, octyl vinyl ether or phenyl vinyl ether;

(m6) vinyl esters, for example, vinyl acetate, vinyl chloroacetate, vinyl butyrate or vinyl benzoate;

(m7) styrenes, for example, styrene, α-methylstyrene, methylstyrene or chloromethylstyrene;

(m8) vinyl ketones, for example, methylvinyl ketone, ethylvinyl ketone, propyl vinyl ketone or phenyl vinyl ketone;

(m9) olefins, for example, ethylene, propylene, isobutylene, butadiene or isoprene;

(m10) N-vinylpyrrolidone, acrylonitrile or methacrylonitrile;

(m11) unsaturated imides, for example, maleimide, N-phenylmaleimide, N-acryloylacrylamide, N-acetylmethacrylamide, N-propionylmethacrylamide or N-(p-chlorobenzoyl)methacrylamide.

Two or more different kinds of other polymer compounds may be used in mixture according to the invention.

Of the other polymer compounds described above, a copolymer having a sulfonamido group and/or a carboxylic acid group is preferable as the other polymer compound used together in the lower layer. Examples of the copolymerization component include an alkyl (meth)acrylate, a (meth)acrylamide, (meth)acrylonitrile and N-phenylmaleimide.

As the other polymer compound used in the upper layer, a novolac resin and a xylenol resin are preferably used. Examples thereof include phenol formaldehyde resin, m-cresol formaldehyde resin, p-cresol formaldehyde resin, m-/p-mixed cresol formaldehyde resin, phenol/cresol (the cresol may be any of m-, p-, o-, m-/p-mixed, m-/o-mixed and o-/p-mixed) mixed formaldehyde resin, 2,3-xylenol resin, 2,4-xylenol resin, 2,5-xylenol resin, 2,6-xylenol resin, 3,4-xylenol resin, 3,5-xylenol resin, xylenol/phenol mixed resin, xylenol/novolac mixed resin, xylenol/novolac/phenol mixed resin.

The amount of other polymer compound added according to the invention is not particularly restricted. In the lower layer, the total amount of the polymer compound (I) and the other polymer compound is preferably from 30 to 99% by weight, more preferably from 50 to 98% by weight, and particularly preferably from 60 to 95% by weight. In the upper layer, the total amount of the polymer compound (I) and the other polymer compound is preferably from 30 to 99% by weight, more preferably from 50 to 98% by weight, and particularly preferably from 60 to 95% by weight. It is preferred that the amount of the polymer compound added is in the range described above because durability of the upper layer and lower layer is increased and sensitivity is enhanced.

[Infrared Absorbing Agent]

In the lithographic printing plate precursor according to the invention, it is preferred to add an infrared absorbing agent to the lower layer in view of high recording sensitivity, uniformity and durability of the lower layer.

The infrared absorbing agent preferably includes known various pigments and dyes. Examples of the pigment include commercially available pigments and pigments described in Colour Index (C.I.), Saishin Ganryo Binran (Handbook of the Newest Pigments) compiled by Pigment Technology Society of Japan (1977), Saishin Ganryo Oyou Gijutsu (Newest Application on Technologies for Pigments), CMC Publishing Co., Ltd. (1986) and Insatsu Ink Gijutsu (Printing Ink Technology), CMC Publishing Co., Ltd. (1984).

Examples of the pigment include black pigments, yellow pigments, orange pigments, brown pigments, red pigments, purple pigments, blue pigments, green pigments, fluorescent pigments, metal powder pigments and polymer-bonded dyes. Specific examples of usable pigment include insoluble azo pigments, azo lake pigments, condensed azo pigments, chelated azo pigments, phthalocyanine pigments, anthraquinone pigments, perylene and perynone pigments, thioindigo pigments, quinacridone pigments, dioxazine pigments, isoindolinone pigments, quinophthalone pigments, dying lake pigments, azine pigments, nitroso pigments, nitro pigments, natural pigments, fluorescent pigments, inorganic pigments and carbon black.

The pigment may be used without undergoing surface treatment or may be used after the surface treatment. For the surface treatment, a method of coating a resin or wax on the surface, a method of attaching a surfactant and a method of bonding a reactive substance (for example, a silane coupling agent, an epoxy compound or polyisocyanate) to the pigment surface. The surface treatment methods are described in Kinzoku Sekken no Seishitsu to Oyo (Properties and Applications of Metal Soap), Saiwai Shobo, Insatsu Ink Gijutsu (Printing Ink Technology), CMC Publishing Co., Ltd. (1984), and Saishin Ganryo Oyo Gijutsu (Newest Application on Technologies for Pigments), CMC Publishing Co., Ltd. (1986).

The pigment has a particle size of preferably from 0.01 to 10 μm, more preferably from 0.05 to 1 μm, particularly preferably from 0.1 to 1 μm. When the particle size of pigment is in the range described above, a coating solution is stable and a uniformity lower layer (photosensitive layer) is obtained.

The particle size of pigment can be determined using a known measuring method. In the specification, the particle size of pigment is indicated as an average value obtained from measurements of plural particle size by observation using an optical microscope, an electron microscope or the like.

In order to disperse the pigment, a known dispersion technique for use in the production of ink or toner can be used. For dispersing the pigment, a dispersing machine, for example, an ultrasonic dispersing machine, a sandmill, an attritor, a pearl mill, a super-mill, a ball mill, an impeller, a disperser, a KD mill, a colloid mill, a dynatron, a three roll mill or a pressure kneader can be used. The dispersing machines are described in detail in Saishin Ganryo Oyo Gijutsu (Newest Application on Technologies for Pigments), CMC Publishing Co., Ltd. (1986).

As the dye, commercially available dyes and known dyes described in literatures, for example, *Senryo Binran* (Dye Handbook) compiled by The Society of Synthetic Organic Chemistry, Japan (1970) can be used. Specifically, the dyes includes azo dyes, metal complex azo dyes, pyrazolone azo dyes, anthraquinone dyes, phthalocyanine dyes, carbonium dyes, quinoneimine dyes, methine dyes and cyanine dyes.

Of the pigments and dyes, pigments and dyes each absorbing an infrared ray or a near infrared ray is particularly preferable because they are adapted to use of a laser emitting an infrared ray or a near infrared ray.

As the pigment absorbing an infrared ray or a near infrared ray, carbon black is preferably used.

As the dye absorbing an infrared ray or a near infrared ray, cyanine dyes described, for example, in JP-A-58-125246, JP-A-59-84356, JP-A-59-202829 and JP-A-60-78787, methine dyes described, for example, in JP-A-58-173696, JP-A-58-181690 and JP-A-58-194595, naphthoquinone dyes described, for example, in JP-A-58-112793, JP-A-58-224793, JP-A-59-48187, JP-A-59-73996, JP-A-60-52940 and JP-A-60-63744, squarylium dyes described, for example, in JP-A-58-112792 and cyanine dyes described, for example, in British Patent 434,875 are exemplified.

Also, near infrared absorbing sensitizers described in U.S. Pat. No. 5,156,938 are preferably used as the dye. Further, substituted arylbenzo(thio)pyrylium salts described in U.S. Pat. No. 3,881,924, trimethinethiapyrylium salts described in JP-A-57-142645 (corresponding to U.S. Pat. No. 4,327,169), pyrylium compounds described in JP-A-58-181051, JP-A-58-220143, JP-A-59-41363, JP-A-59-84248, JP-A-59-84249, JP-A-59-146063 and JP-A-59-146061, cyanine dyes described in JP-A-59-216146, pentamethinethiopyrylium salts described in U.S. Pat. No. 4,283,475, pyrylium compounds described in JP-B-5-13514 (the term "JP-B" as used herein means an "examined Japanese patent publication") and JP-B-5-19702, Epolight III-178, Epolight III-130, Epolight III-125 and Epolight III-176A are particularly preferably used.

Other particularly preferable examples of the dye include near infrared absorbing dyes represented by formulae (I) and (II) in U.S. Pat. No. 4,756,993.

The amount of the pigment or dye added as the infrared absorbing agent is preferably from 0.01 to 50% by weight, more preferably from 0.1 to 10% by weight, based on the total solid content of the lower layer.

The amount is particularly preferably from 0.5 to 10% by weight in case of the dye, and from 3.1 to 10% by weight in case of the pigment.

It is preferred that the amount of the pigment or dye added is in the range described above because high recording sensitivity is obtained and uniformity and durability of the lower layer (photosensitive layer) are high.

The infrared absorbing agent may be incorporated into the upper layer in order to enhance sensitivity. The content of the infrared absorbing agent in such a case is preferably from 0.01 to 50% by weight, more preferably from 0.1 to 30% by weight, based on the total solid content of the upper layer.

[Other Components]

To the layer of the lithographic printing plate precursor according to the invention, various additives may further be added, if desired.

For instance, in order to control the dissolution of the layer of the lithographic printing plate precursor, it is preferred to add a so-called dissolution inhibiting agent, for example, an onium salt, an aromatic sulfone compound, an aromatic sulfonic acid ester compound or a polyfunctional amine compound, which has a function of inhibiting dissolution of an aqueous alkali soluble polymer (alkali-soluble resin) in a developer. In particular, it is preferred to use a substance, which is thermally decomposable and can substantially decrease the solubility of the alkali-soluble resin before being thermally decomposed, for example, an onium salt, an o-quinonediazide compound or a sulfonic acid alkyl ester in view of controlling the dissolution inhibiting property of the image area in a developer.

Preferable examples of the onium salt for use in the invention include diazonium salts described in S. I. Schlesinger, *Photogr. Sci. Eng.,* 18, 387 (1974), T. S. Bal et al., *Polymer,* 21, 423 (1980) and JP-A-5-158230, ammonium salts described in U.S. Pat. Nos. 4,069,055 and 4,069,056 and JP-A-3-140140, phosphonium salts described in D. C. Necker et al., *Macromolecules,* 17, 2468 (1984), C. S. Wen et al., *Teh, Proc. Conf. Rad. Curing ASIA*, p. 478, Tokyo, October (1988) and U.S. Pat. Nos. 4,069,055 and 4,069,056, iodonium salts described in J. V. Crivello et al., *Macromolecules,* 10 (6), 1307 (1977), *Chem. & Eng. News*, November 28, p. 31

(1988), European Patent 104,143, U.S. Pat. Nos. 5,041,358 and 4,491,628, JP-A-2-150848 and JP-A-2-296514, sulfonium salts described in J. V. Crivello et al., *Polymer J.,* 17, 73 (1985), J. V. Crivello et al., *J. Org. Chem.,* 43, 3055 (1978), W. R. Watt et al., *J. Polymer Sci., Polymer Chem. Ed.,* 22, 1789 (1984), J. V. Crivello et al., *Polymer Bull.,* 14, 279 (1985), J. V. Crivello et al., *Macromolecules,* 14 (5), 1141 (1981), J. V. Crivello et al., *J. Polymer Sci., Polymer Chem. Ed.,* 17, 2877 (1979), European Patents 370,693, 233,567, 297,443 and 297,442, U.S. Pat. Nos. 4,933,377, 3,902,114, 5,041,358, 4,491,628, 4,760,013, 4,734,444 and 2,833,827, and German Patents 2,904,626, 3,604,580 and 3,604,581, selenonium salts described in J. V. Crivello et al., *Macromolecules,* 10 (6), 1307 (1977) and J. V. Crivello et al., *J. Polymer Sci., Polymer Chem. Ed.,* 17, 1047 (1979), and arsonium salts described in C. S. Wen et al., *Teh, Proc. Conf. Rad. Curing ASIA*, p. 478, Tokyo, October (1988).

Among the onium salts, diazonium salts and quaternary ammonium salts are particularly preferred in view of the dissolution inhibiting property and thermal decomposability. In particular, as the diazonium salt, diazonium salts represented by formula (I) in JP-A-5-158230 and diazonium salts represented by formula (1) in JP-A-11-143064 are preferable and the diazonium salts represented by formula (1) in JP-A-11-143064 having a small absorption wavelength in the visible light range are most preferable. As the quaternary ammonium salt, quaternary ammonium salts shown as (1) to (10) in [Chemical Formula 1] and [Chemical Formula 2] of JP-A-2002-229186 are preferable.

Examples of the counter ion of the onium salt include tetrafluoroboric acid, hexafluorophosphoric acid, triisopropylnaphthalenesulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxy-4-hydroxy-5-benzoylbenzenesulfonic acid and p-toluenesulfonic acid. Among these compounds, hexafluorophosphoric acid and an alkyl aromatic sulfonic acid, for example, triisopropylnaphthalenesulfonic acid or 2,5-dimethylbenzenesulfonic acid are preferred.

Preferable examples of the quinonediazide include o-quinonediazide compounds. The o-quinonediazide compound for use in the invention is a compound having at least one o-quinonediazido group, which increases the alkali solubility upon thermal decomposition, and compounds having various structures can be used. In other words, o-quinonediazide assists dissolution of the photosensitive system by its two effects, that is, the o-quinonediazide loses the dissolution inhibiting ability to the binder upon thermal decomposition and the o-quinonediazide itself changes into an alkali-soluble substance.

Examples of the o-quinonediazide compound for use in the invention include compounds described in J. Kosar, *Light-Sensitive Systems*, pages 339 to 352, John Wiley & Sons, Inc. In particular, sulfonic acid esters or sulfonic acid amides of o-quinonediazide obtained by reacting with various aromatic polyhydroxy compounds or aromatic amino compounds are preferred. Also, ester of benzoquinone-(1,2)-diazidosulfonic chloride or naphthoquinone-(1,2)-diazido-5-sulfonic chloride with a pyrogallol-acetone resin described in JP-B-43-28403, and ester of benzoquinone-(1,2)-diazidosulfonic chloride or naphthoquinone-(1,2)-diazido-5-sulfonic chloride with a phenol-formaldehyde resin described in U.S. Pat. Nos. 3,046,120 and 3,188,210 are preferably used.

Furthermore, an ester of naphthoquinone-(1,2)-diazido-4-sulfonic chloride with a phenol-formaldehyde resin or cresol-formaldehyde resin, and an ester of naphthoquinone-(1,2)-diazido-4-sulfonic chloride with a pyrogallol-acetone resin are also preferably used. Other useful o-quinonediazide compounds are described in a large number of patents, for example, JP-A-47-5303, JP-A-48-63802, JP-A-48-63803, JP-A-48-96575, JP-A-49-38701, JP-A-48-13354, JP-B-41-11222, JP-B-45-9610, JP-B-49-17481, U.S. Pat. Nos. 2,797,213, 3,454,400, 3,544,323, 3,573,917, 3,674,495 and 3,785,825, British Patents 1,227,602, 1,251,345, 1,267,005, 1,329,888 and 1,330,932, and German Patent 854,890.

The amount of the onium salt and/or o-quinonediazide compound added as the decomposable dissolution inhibiting agent is preferably from 1 to 10% by weight, more preferably from 1 to 5% by weight, particularly preferably from 1 to 2% by weight, based on the total solid content of each layer for the lithographic printing plate precursor. These compounds may be used individually or as a mixture of a plurality of the compounds.

The amount of the additive other than the o-quinonediazide compound add is preferably from 0.1 to 5% by weight, more preferably from 0.1 to 2% by weight, particularly preferably from 0.1 to 1.5% by weight. The additive and binder according to the invention are preferably incorporated into the same layer.

A dissolution inhibiting agent having no decomposability may be used. Preferable examples of such dissolution inhibiting agent include sulfonic acid esters, phosphoric acid esters, aromatic carboxylic acid esters, aromatic disulfones, carboxylic acid anhydrides, aromatic ketones, aromatic aldehydes, aromatic amines and aromatic ethers described in detail in JP-A-10-268512, acid color-formable dyes which have a lactone skeleton, an N,N-diarylamide skeleton or a diarylmethylimino skeleton and also function as a coloring agent described in detail in JP-A-11-190903, and nonionic surfactants described in detail in JP-A-2000-105454.

In order to enhance sensitivity, the lithographic printing plate precursor according to the invention may also contain a cyclic acid anhydride, a phenol compound or an organic acid. Further, a surfactant, an image coloring agent and a plasticizer described below may used in the lower layer which functions as a positive-working recording layer in the invention and also, if desired, in the upper layer.

Examples of the cyclic acid anhydride include phthalic anhydride, tetrahydrophthalic anhydride, 3,6-endooxy-4-tetrahydrophthalic anhydride, tetrachlorophthalic anhydride, maleic anhydride, chloromaleic anhydride, α-phenylmaleic anhydride, succinic anhydride and pyromellitic anhydride described in U.S. Pat. No. 4,115,128.

Examples of the phenol compound include bisphenol A, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, 4,4',3",4"-tetrahydroxy-3,5,3',5'-tetramethyltriphenylmethane.

Examples of the organic acid include sulfonic acids, sulfinic acids, alkylsulfuric acids, phosphonic acids, phosphates, and carboxylic acids described in JP-A-60-88942 and JP-A-2-96755.

The content of the cyclic acid anhydride, phenol compound or organic acid in the upper layer or lower layer of the lithographic printing plate precursor is preferably from 0.05 to 20% by weight, more preferably from 0.1 to 15% by weight, and particularly preferably from 0.1 to 10% by weight.

In addition, an epoxy compound, a vinyl ether, a phenol compound having a hydroxymethyl group or a phenol compound having an alkoxymethyl group described in JP-A-8-

276558 or a crosslinkable compound having an alkali dissolution inhibiting function described in JP-A-11-160860 previously proposed by the inventors may be appropriately added, if desired.

Moreover, a print-out agent for obtaining a visible image immediately after heating by exposure to light or a dye or a pigment as an image coloring agent may be added.

A typical example of the print-out agent is a combination of a compound which is heated by exposure to light to release an acid (photoacid generating agent) and an organic dye capable of forming a salt.

Specific examples thereof include combinations of an o-naphthoquinonediazido-4-sulfonic acid halogenide with a salt-forming organic dye described in JP-A-50-36209 and JP-A-53-8128, and combinations of a trihalomethyl compound with a salt-forming organic dye described in JP-A-53-36223, JP-A-54-74728, JP-A-60-3626, JP-A-61-143748, JP-A-61-151644 and JP-A-63-58440. The trihalomethyl compound includes an oxazole compound and a triazine compound. Both of the compounds are excellent in preservation stability and produce a clear print-out image.

As the image coloring agent, a dye may be used as well as the salt-forming organic dye described above. Preferable examples of the dye include oil-soluble dyes and basic dyes in addition to the salt-forming organic dye. Specific examples thereof include Oil Yellow #101, Oil Yellow #103, Oil Pink #312, Oil Green BG, Oil Blue BOS, Oil Blue #603, Oil Black BY, Oil Black BS and Oil Black T-505 (produced by Orient Chemical Industries Ltd.), Victoria Pure Blue, Crystal Violet (CI42555), Methyl Violet (CI42535), Ethyl Violet, Rhodamine B (CI45170B), Malachite Green (CI42000), and Methylene Blue (CI52015). Dyes described in JP-A-62-293247 are particularly preferable.

The dye may be added to the upper layer or lower layer in an amount of 0.01 to 10% by weight, preferably 0.1 to 3% by weight, based on the total solid content of the upper layer or lower layer.

Furthermore, a plasticizer may be added to the lithographic printing plate precursor according to the invention in order to impart flexibility to a coating film formed.

Examples of the plasticizer include butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl olete, and oligomers and polymers of acrylic acid or methacrylic acid.

[Coating Solvent and Coating Method]

The lithographic printing plate precursor according to the invention can be produced by dissolving the components, for example, the polymer compound and infrared absorbing agent contained in the lower layer and upper layer to prepare coating solutions respectively and coating the coating solution for the lower layer and the coating solution for the upper layer in order on a support having a hydrophilic surface to form the lower layer and upper layer on the support.

If desired, a protective layer, a resin intermediate layer, a backcoat layer or the like can be formed in the same manner as above.

Examples of the solvent used include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butyrolactone and toluene, but the invention should not be construed as being limited thereto. The solvents may be used individually or as a mixture thereof.

The concentration of the above-described components (total solid content including additives) is preferably from 1 to 50% by weight.

The coating amount of solid content on the support obtained after coating and drying is preferably from 0.05 to 2.0 g/m$^2$ for the upper layer and from 0.3 to 5.0 g/m$^2$ for the lower layer, more preferably from 0.1 to 1.0 g/m$^2$ for the upper layer and from 0.5 to 3.0 g/m$^2$ for the lower layer. A ratio of coating amounts of the upper layer and the lower layer (upper layer/lower layer) is preferably from 0.05 to 1 and more preferably from 0.1 to 0.8.

For the coating of each of the coating solutions for the upper layer and lower layer, various methods can be used and examples thereof include bar coater coating, spin coating, spray coating, curtain coating, dip coating, air knife coating, blade coating and roll coating. As the coating amount becomes small, the apparent sensitivity becomes higher but the film property of the photosensitive layer is more degraded.

[Support]

As the support for use in the lithographic printing plate precursor according to the invention, a support having a hydrophilic surface is used.

The support for use in the invention is not particularly restricted as long as a dimensionally stable plate-like material satisfying necessary physical property, for example, strength and flexibility. Examples of the support include paper, paper laminated with plastic (for example, polyethylene, polypropylene or polystyrene), a metal plate (for example, an aluminum, zinc or copper plate), a plastic film (for example, a cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate or polyvinyl acetal film), and paper or plastic film having laminated or deposited thereon the metal described above.

The support for use in the lithographic printing plate precursor is preferably a polyester film or an aluminum plate. Among them, the aluminum plate is particularly preferred, since it is dimensionally stable and relatively inexpensive.

The aluminum plate is preferably a pure aluminum plate or an alloy plate mainly comprising aluminum and containing a trace amount of foreign element. A plastic film having laminated or deposited thereon aluminum may also be used.

Examples of the foreign element contained in the aluminum alloy include silicon, iron, manganese, copper, magnesium, chromium, zinc, bismuth, nickel and titanium. The content of foreign element in the alloy is at most 10% by weight.

In the invention, particularly preferable aluminum is pure aluminum but since perfectly pure aluminum is difficult to produce in view of the refining technique, the aluminum may contain a trace amount of foreign element.

The aluminum plate for use in the invention is not particularly limited on the composition and an aluminum plate conventionally known and commonly used can be appropriately used. The thickness of the aluminum plate for use in the invention is approximately from 0.1 to 0.6 mm, and preferably from 0.12 to 0.4 mm.

An aluminum plate is subjected to surface roughening to make the surface hydrophilic for using. Prior to the surface roughening of an aluminum plate, a degreasing treatment using, for example, a surfactant, an organic solvent or an aqueous alkaline solution is performed, if desired, in order to remove the rolling oil on the surface.

The surface roughening treatment of the aluminum plate is performed by various methods, for example, by a method of mechanically roughening the surface, a method of electrochemically dissolving and roughening the surface or a method of chemically dissolving selectively the surface.

In the mechanical roughening method, a known method, for example, a ball graining method, a brush graining method, a blast graining method or a buff graining method may be used. The electrochemical surface roughening method includes a method of performing the treatment by applying an alternating current or direct current through an electrolytic solution containing hydrochloric acid or nitric acid. A method using both treatments in combination described in JP-A-54-63902 may also be used.

It is preferred to include at least a step of surface roughening in a hydrochloric acid electrolytic solution.

The aluminum plate thus-surface roughened is, if desired, subjected to an alkali etching treatment and a neutralization treatment and then, if desired, to an anodizing treatment so as to enhance the water retentivity or abrasion resistance on the surface.

The electrolyte which can be used in the anodizing treatment of aluminum plate includes various electrolytes capable of forming a porous oxide film, and sulfuric acid, phosphoric acid, oxalic acid, chromic acid or a mixed acid thereof is ordinarily used.

The concentration of the electrolyte is appropriately determined depending on the kind of electrolyte.

Since the conditions of anodizing treatment may vary depending on the electrolyte used, they cannot be indiscriminately specified, however, suitable conditions are ordinarily such that the concentration of electrolyte is from 1 to 80% by weight, the solution temperature is from 5 to 70° C., the current density is from 5 to 60 A/dm$^2$, the voltage is from 1 to 100 V, and the electrolysis time is from 10 seconds to 5 minutes.

When the amount of anodic oxide film is less than 1.0 g/m$^2$, printing durability is insufficient or the non-image area of lithographic printing plate is readily scratched to cause so-called "scratch stain", namely, adhesion of ink to the scratched part at the printing.

After the anodizing treatment, the aluminum surface is, if desired, subjected to a hydrophilization treatment. Examples of the hydrophilization treatment for use in the invention include a method of using an alkali metal silicate (for example, an aqueous sodium silicate solution) described in U.S. Pat. Nos. 2,714,066, 3,181,461, 3,280,734 and 3,902,734. According to the method, the support is immersed or electrolyzed in an aqueous sodium silicate solution. Further, a method of treating the support with potassium fluorozirconate described in JP-B-36-22063 or a method of treating the support with polyvinylphosphonic acid described in U.S. Pat. Nos. 3,276,868, 4,153,461 and 4,689,272 can be used.

[Undercoat Layer]

The lithographic printing plate precursor according to the invention comprises the lower layer described above on the support but, if desired, an undercoat layer may be provided between the lower layer and the support.

By providing the undercoat layer, since the undercoat layer between the support and the lower layer functions as a heat-insulating layer, the heat generated by exposure to an infrared laser is effectively used without diffusion into the support, thereby achieving the advantage of enhancing sensitivity.

When the undercoat layer is provided, the lower layer according to the invention is positioned on the exposure face or in the vicinity thereof, and thus preferably retains its sensitivity to an infrared laser.

Also in the unexposed area, it is believed that since the lower layer which is resistant to penetration of an alkali developer functions as a protective layer for the undercoat layer, development stability is improved, an image having excellent discrimination is formed and preservation stability is also ensured.

On the other hand, in the exposed area, the components the dissolution inhibiting function of which is removed in the lower layer is readily dissolved or dispersed in the developer. Since the undercoat layer per se positioned adjacent to the support comprises an alkali-soluble polymer, it has excellent solubility in the developer. Thus, even when a developer of reduced activity is used, the undercoat layer is readily dissolved without generation of remaining film to contribute improvement in the developing property. Accordingly, the undercoat layer is believed to be useful.

Various organic compounds may be used as the component for the undercoat layer, and examples thereof include carboxymethyl cellulose, dextrin, gum arabic, an amino group-containing phosphonic acid, for example, 2-aminoethylphosphonic acid, an organic phosphonic acid which may have a substituent, for example, phenylphosphonic acid, naphthylphosphonic acid, an alkylphosphonic acid, glycerophosphonic acid, methylenediphosphonic acid or ethylenediphosphonic acid, an organic phosphoric acid which may have a substituent, for example, phenylphosphoric acid, naphthylphosphoric acid, an alkylphosphoric acid or glycerophosphoric acid, an organic phosphinic acid which may have a substituent, for example, phenylphosphinic acid, naphthylphosphinic acid, an alkylphosphinic acid or glycerophosphinic acid, an amino acid, for example, glycine or β-alanine, and a hydroxy group-containing amine hydrochloride, for example, triethanolamine hydrochloride. These compounds may be used in combinations of two or more thereof.

An undercoat layer containing at least one compound selected from the group consisting of organic polymer compounds having the structural unit represented by the formula shown below is also preferable.

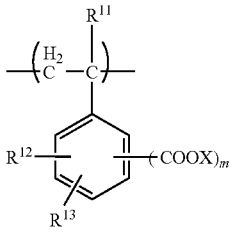

In the formula above, $R^{11}$ represents a hydrogen atom, a halogen atom or an alkyl group, $R^{12}$ and $R^{13}$ each independently represents a hydrogen atom, a hydroxy group, a halogen atom, an alkyl group, a substituted alkyl group, an aryl group, a substituted aryl group, —$OR^{14}$, —$COOR^{15}$, —$CONHR^{16}$, —$COR^{17}$ or —CN, or $R^{12}$ and $R^{13}$ may be combined with each other to form a ring, $R^{14}$ to $R^{17}$ each independently represents an alkyl group or an aryl group, X represents a hydrogen atom, a metal atom or $NR^{18}R^{19}R^{20}R^{21}$, $R^{18}$ to $R^{21}$ each independently represents a hydrogen atom, an alkyl group, a substituted alkyl group, an aryl group or a substituted aryl group, or $R^{18}$ and $R^{19}$ may be combined with each other to form a ring, and m represents an integer of 1 to 3.

Also, as an undercoat layer component suitable for the invention, a polymer compound having an acid group-containing structural unit and an onium group-containing structural unit described in JP-A-2000-241962 is exemplified.

Specifically, a copolymer of an acid group-containing monomer and an onium group-containing monomer is exemplified.

The acid group is preferably an acid group having an acid dissociation constant (pKa) of 7 or more, more preferably —COOH, —$SO_3H$, —$OSO_3H$, —$PO_3H_2$, —$OPO_3H_2$, —$CONHSO_2$— or —$SO_2NHSO_2$—, and particularly preferably —COOH.

Specific examples of the acid group-containing monomer include acrylic acid, methacrylic acid, crotonic acid, isocrotonic acid, itaconic acid, maleic acid, maleic anhydride, a styrene derivative having the above-described acid group.

The onium group is preferably an onium group comprising an atom in Group V or VI of the Periodic Table, more preferably an onium group comprising a nitrogen atom, a phosphorus atom or a sulfur atom, and particularly preferably an onium group comprising a nitrogen atom. Specific examples of the onium group-containing monomer include a methacrylate or methacrylamide having an ammonium group on its side chain, and a styrene having an onium group-containing substituent, for example, a substituent having an onium group, for example, a quaternary ammonium group.

In addition, compounds described, for example, in JP-A-2000-108538 and Japanese Patent Application Nos. 2002-257484 and 2003-78699 may be used, if desired.

The undercoat layer can be formed, for example, according to the following methods. Specifically, there are a method of dissolving the organic compound in water, an organic solvent, for example, methanol, ethanol or methyl ethyl ketone or a mixed solvent thereof, and coating and drying the solution on an aluminum plate, and a method of dissolving the organic compound in water, an organic solvent, for example, methanol, ethanol or methyl ethyl ketone or a mixed solvent thereof, immersing an aluminum plate in the solution to absorb the organic compound, washing the plate, for example, with water, and drying it.

In the former method, the solution of the organic compound at a concentration of 0.005 to 10% by weight is coated by various methods.

In the latter method, the concentration of the solution is from 0.01 to 20% by weight, preferably from 0.05 to 5% by weight, the immersion temperature is from 20 to 90° C., preferably from 25 to 50° C., the immersion time is from 0.1 second to 20 minutes, preferably from 2 seconds to 1 minute. The solution used may be adjusted pH in a range of 1 to 12 by addition of a basic substance, for example, ammonia, triethylamine or potassium hydroxide, or an acidic substance, for example, hydrochloric acid or phosphoric acid.

A yellow dye may also be added to the undercoat layer in order to improve tone reproducibility in the lithographic printing plate precursor.

The coating amount of the undercoat layer is suitably in a range of 2 to 200 mg/$m^2$, and preferably in a range of 5 to 100 mg/$m^2$. When the coating amount is less than 2 mg/$m^2$, sufficient printing durability may not be obtained. When the coating amount is more than 200 mg/$m^2$, also sufficient printing durability may not be obtained.

[Exposure]

An image is thermally formed on the lithographic printing plate precursor according to the invention. Specifically, the image formation is preferably performed upon exposure with a semiconductor laser emitting an infrared ray having a wavelength of 700 to 1,200 nm or a high-output infrared solid laser, for example, a YAG laser.

Also, for instance, direct imagewise recording, for example, with a thermal recording head, high-illumination flash exposure, for example, with a xenon discharge lamp, or infrared lamp exposure may be used.

The output of the infrared laser is preferably 100 mW or more, and it is preferred to use a multi-beam laser device in order to shorten the exposure time. The exposure time per pixel is preferably 20 μsec or less, and the energy applied onto the lithographic printing plate precursor is preferably from 10 to 500 mJ/$cm^2$.

[Development]

In the invention, the lithographic printing plate precursor is preferably developed with an aqueous alkaline solution which does not substantially contain an organic solvent and has pH of 12 or higher. The terminology "does not substantially contain an organic solvent" as used herein means that an organic solvent is not contained to an extent that causes an inconvenience from the viewpoint of environmental health, safety and workability. In the invention, it means that a ratio of the organic solvent in the developer is 0.5% by weight or less, preferably 0.3% by weight or less, and most preferably zero. Further, the pH thereof is preferably 12.0 or higher, and more preferably from 12.0 to 14.0.

As the developer (hereinafter, the term represents a developer including a replenisher), a conventionally known aqueous alkali solution can be used. Examples of the alkali agent used include an inorganic alkali salt, for example, sodium silicate, potassium silicate, sodium tertiary phosphate, potassium tertiary phosphate, ammonium tertiary phosphate, sodium secondary phosphate, potassium secondary phosphate, ammonium secondary phosphate, sodium carbonate, potassium carbonate, ammonium carbonate, sodium hydrogen carbonate, potassium hydrogen carbonate, ammonium hydrogen carbonate, sodium borate, potassium borate, ammonium borate, sodium hydroxide, ammonium hydroxide, potassium hydroxide or lithium hydroxide. Also, an organic alkali agent, for example, monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine or pyridine is used. The alkali agents may be used individually or in combination of two or more thereof.

Among the above aqueous alkali solutions, one developer which exerts the effect of the invention is an aqueous solution of pH 12 or higher so-called "silicate developer" containing an alkali silicate as a base or containing an alkali silicate obtained by mixing a base with a silicon compound, and the other more preferable developer is a so-called "non-silicate developer" which does not contain an alkali silicate and contains a non-reducing sugar (organic compound having a buffering action) and a base.

In the silicate developer, developing property of an aqueous solution of alkali metal silicate can be regulated by a ratio (ordinarily represented by a mole ratio of $[SiO_2]/[M_2O]$) of silicon oxide $SiO_2$ and alkali metal oxide $M_2O$ which are components of the silicate and a concentration. For example, an aqueous solution of sodium silicate in which a mole ratio of $SiO_2/Na_2O$ is from 1.0 to 1.5 (that is, $[SiO_2]/[Na_2O]$ is from 1.0 to 1.5), and a content of $SiO_2$ is from 1 to 4% by weight as described in JP-A-54-62004, and an aqueous solution of alkali metal silicate in which $[SiO_2]/[M]$ is from 0.5 to 0.75 (that is, $[SiO_2]/[M_2O]$ is from 1.0 to 1.5) and a concentration of $SiO_2$ is from 1 to 4% by weight, and which contains at least 20% potassium based on gram atom of the total alkali metal present therein, as described in JP-B-57-7427 are preferably used.

In case of the so-called "non-silicate developer" which does not contain an alkali silicate and contains a non-reducing sugar and a base, it is preferred to contain a non-reducing sugar having a buffering property for restraining the fluctuation of pH.

The non-reducing sugar is a sugar which neither have a free aldehyde group and ketone group nor exhibit the reducing property and can be categorized into a trehalose type oligosaccharide where reducing groups are bonded each other, a glycoside where a reducing group of sugar and a non-sugar are bonded, and a sugar alcohol obtained by adding hydrogen to a sugar to reduce. Any one thereof can be used in the invention. In the invention, non-reducing sugars described in JP-A-8-305039 can be preferably used.

Examples of the trehalose type oligosaccharide include saccharose and trehalose. Examples of the glycoside include alkylglycoside, phenolglycoside and mustard seed oil glycoside. Examples of the sugar alcohol include D,L-arabite, ribitol, xylitol, D,L-sorbitol, D,L-mannitol, D,L-iditol, D,L-talitol, dulcitol and allodulcitol. Further, maltitol obtained by hydrogenating maltose which is a disaccharide, and a reductant (i.e., reduced starch syrup) obtained by hydrogenating an oligosaccharide are preferably exemplified. Of the non-reducing sugars, trehalose type oligosaccharide and sugar alcohol are preferable. D-sorbitol, saccharose and reduced starch syrup are more preferable since they exhibit the buffering function in an appropriate pH range and are inexpensive.

The non-reducing sugars may be used individually or in combination of two or more thereof.

The content of the non-reducing sugar in the non-silicate developer is preferably from 0.1 to 30% by weight, and more preferably from 1 to 20% by weight. When the content is in the range of 0.1 to 30% by weight, a suitable buffering function is obtained and it is advantageous in view of making a highly concentrated solution and reducing the cost.

The base used in combination with the non-reducing sugar includes a conventionally known alkali agent, for example, an inorganic alkali agent and an organic alkali agent. Examples of the inorganic alkali agent include sodium hydroxide, potassium hydroxide, lithium hydroxide, trisodium phosphate, tripotassium phosphate, triammonium phosphate, disodium phosphate, dipotassium phosphate, diammonium phosphate, sodium carbonate, potassium carbonate, ammonium carbonate, sodium hydrogencarbonate, potassium hydrogencarbonate, ammonium hydrogencarbonate, sodium borate, potassium borate and ammonium borate.

Examples of the organic alkali agent include monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine and pyridine.

The bases may be used individually or in combination of two or more thereof. Among the bases, sodium hydroxide and potassium hydroxide are preferable. In the invention, a developer containing as the main component, an alkali metal salt of a non-reducing sugar in place of the combination of the non-reducing sugar and base may be used as the non-silicate developer.

Alternatively, an alkaline buffer solution containing a weak acid other than the non-reducing sugar and a strong base may be used as the non-silicate developer. The weak acid preferably has a dissociation constant (pKa) of 10.0 to 13.2, and is selected from weak acids described, for example, in *Ionization Constants of Organic Acids in Aqueous Solution*, published by Pergamon Press Ltd.

Specifically, suitable examples thereof include an alcohol, for example, 2,2,3,3-tetrafluoropropanol-1, trifluoroethanol or trichloroethanol, an aldehyde, for example, pyridine-2-aldehyde or pyridine-4-aldehyde, a compound having a phenolic hydroxyl group, for example, salicylic acid, 3-hydroxy-2-naphthoic acid, catechol, gallic acid, sulfosalicylic acid, 3,4-dihydroxysulfonic acid, 3,4-dihydroxybenzoic acid, hydroquinone, pyrogallol, o-, m- or p-cresol or resorcinol, an oxime, for example, acetoxime, 2-hydroxybenzaldehyde oxime, dimethyl glyoxime, ethanediamide dioxime or acetophenone oxime, a nucleic acid-related substance, for example, adenosine, inosine, guanine, cytosine, hypoxanthine or xanthene, diethylaminomethylphosphonic acid, benzimidazole and barbituric acid.

Various surfactants and organic solvents may be added to the developer, if desired, for the purpose of acceleration or suppression of developing property, dispersion of development scum or enhancement of the ink compatibility of the image area of a printing plate. The surfactant is preferably an anionic, cationic, nonionic or amphoteric surfactant. In addition, a reducing agent, for example, hydroquinone, resorcin, sodium or potassium salt of an inorganic acid, for example, sulfurous acid or bisulfurous acid as well as an organic carboxylic acid, an antifoaming agent, a water softener or the like may be added to the developer.

The lithographic printing plate obtained by the development processing using the developer is then post-treated with washing water, a rinse solution containing a surfactant or the like, or a desensitizing solution containing gum arabic or a starch derivative. These treatments may be used in combination as the post-treatment.

Further, in the case of performing development using an automatic developing machine, it is known that when an aqueous solution (replenisher) stronger in the alkalinity than that of the developer is added to the developer, considerable amount of PS plates can be processed without exchanging the developer in a developing tank for a long period of time. The replenishing process can be preferably applied to the invention.

In recent years, an automatic developing machine for printing plate has become widely used for the purpose of streamlining and standardizing the plate making process in the plate making and printing industries. The automatic developing machine ordinarily comprises a developing unit and a post-treatment unit as well as a device for conveying a printing plate precursor, each stock solution tank and a device for spraying solution, wherein an exposed lithographic printing plate precursor is developed while it is conveyed horizontally and sprayed via a spray nozzle with each solution pumped out of the stock tank. Also, another method is recently known wherein a lithographic printing plate precursor is conveyed while it is immersed in a processing solution bath filled with a processing solution by means of submerged guide rolls or the like. In such automatic processing, the lithographic printing plate precursor is processed while replenishing a replenisher in each processing solution according to the number of lithographic printing plate precursors processed and the operating time. In addition, a method of essentially using only an unused processing solution, that is, a so-called single-use processing method may also be used.

In the invention, if the lithographic printing plate obtained after the steps of image exposure, development, water washing and/or rinsing and/or gumming has an unnecessary image portion (for example, a film edge spot of the original film), elimination of the unnecessary image portion is performed. For the elimination, although a method wherein an image erasing solution is applied onto the undesirable image portion and the printing plate is allowed to stand for a certain period of time and then washed with water as described, for example, in JP-B-2-13293 is preferable, a method wherein the undesirable image portion is irradiated with active light through an optical fiber and then the printing plate is developed as described in JP-A-59-174842 may be also used.

The thus-obtained lithographic printing plate is, if desired, coated with a desensitizing gum and then can be used for printing. However, when a lithographic printing plate having higher printing durability is desired, the printing plate is subjected to a baking treatment.

In the case of baking the lithographic printing plate, the printing plate before baking is preferably treated with a surface conditioning solution described, for example, in JP-B-61-2518, JP-B-55-28062, JP-A-62-31859 and JP-A-61-159655.

The treatment may be performed by a method of applying the surface conditioning solution on the lithographic printing plate using a sponge or an absorbent cotton impregnated with the surface conditioning solution, a method of applying the surface conditioning solution by immersing the printing plate in a vat filled with the surface conditioning solution, or a method of applying the surface conditioning solution using an automatic coater. When the amount of surface conditioning solution applied is made uniform by a squeegee or a squeegee roller after the application, more preferable results can be obtained.

The amount of the surface conditioning solution applied is ordinarily from 0.03 to 0.8 g/m$^2$ (dry weight). The lithographic printing plate applied with the surface conditioning solution is dried, if desired, and then heated at high temperature by a baking processor (for example, burning processor "BP-1300" commercially available from Fuji Film Co., Ltd.). The heating temperature and the heating time are preferably from 180 to 300° C. and from 1 to 20 minutes, respectively, though these may be varied depending on the kinds of components constituting the image.

The lithographic printing plate after to the baking treatment may be subjected, if desired, to treatment conventionally practiced in the art, for example, water washing or gumming. However, when the surface conditioning solution containing a water-soluble polymer compound or the like is used, a so-called desensitizing treatment, for example, gumming may be eliminated. The lithographic printing plate obtained through such treatment is mounted on an offset printing machine and used for printing a large number of sheets.

EXAMPLES

The invention will be described in greater detail with reference to the following examples, but the invention should not be construed as being limited thereto.

Example 1

An aluminum plate of JIS A1050 having a thickness of 0.3 mm was treated according to the steps shown below to prepare a support.

The aluminum plate was subjected to an etching treatment by splaying an aqueous sodium hydroxide solution (sodium hydroxide concentration: 26% by weight; aluminum ion concentration: 6.5% by weight) having a temperature of 70° C. to dissolve 6 g/m$^2$ of the aluminum plate. Thereafter, water washing of the plate was carried out by spraying well water.

A desmut treatment was then carried out by spraying an aqueous solution having a nitric acid concentration of 1% by weight (containing 0.5% by weight of aluminum ion) having a temperature of 30° C., and thereafter the aluminum plate was water washed by spraying.

Using alternating current of 60 Hz, an electrochemical surface roughening treatment was continuously carried out. The electrolytic solution used was an aqueous solution of 7.5 g/liter of hydrochloric acid (containing 5 g/liter of aluminum ion) and the temperature was 35° C. The electrochemical surface roughening treatment was conducted using an alternating current source which provides a trapezoidal rectangular wave alternating current and using a carbon electrode as a counter electrode. A ferrite was used as an auxiliary anode. As an electrolysis vessel, a radial cell type was used.

The current density was 25 A/dm$^2$ in the peak value of the electric current and the quantity of electricity was 450 C/dm$^2$ in terms of the total quantity of electricity during the aluminum plate functioning as an anode.

Thereafter, water washing of the plate was carried out by spraying well water.

The aluminum plate was subjected to an etching treatment by spraying an aqueous solution having a sodium hydroxide concentration of 26% by weight and an aluminum ion concentration of 6.5% by weight at 32° C. to dissolve 0.10 g/m$^2$ of the aluminum plate, whereby the smut components mainly composed of aluminum hydroxide formed in the electrochemical surface roughening treatment using alternating current in the preceding step were removed and also, the edge portions of pits formed were dissolved to make the edge portions smooth. Thereafter, water washing of the plate was carried out by spraying well water.

A desmut treatment was carried out by spraying an aqueous solution having a sulfuric acid concentration of 25% by weight (containing 0.5% by weight of aluminum ion) having a temperature of 60° C. and thereafter, water washing of the plate was carried out by spraying well water.

The aluminum plate was subjected to an anodizing treatment. The electrolytic solution used was an aqueous solution of sulfuric acid of 170 g/liter (containing 0.5% by weight of aluminum ion) and the temperature thereof was 43° C. Thereafter, water washing of the plate was carried out by spraying well water.

The current density was about 30 A/dm$^2$. The final amount of the anodized film formed was 2.7 g/m$^2$.

Thereafter, the aluminum plate subjected to the anodizing treatment was immersed in an aqueous 0.5% by weight polyvinylphosphonic acid solution heated at 60° C. for 5 seconds, followed by water washing with spraying.

Thus, a support for a photosensitive lithographic printing plate was obtained.

Coating solution A for lower layer having the composition shown below was coated on the support by a wire bar and dried in an oven for drying set at 140° C. for 50 seconds to form a lower layer. The coating amount of the lower layer after drying was 1.2 g/m$^2$.

<Coating Solution A for Lower Layer>

| | |
|---|---|
| Example (1) of Polymer Compound (I) described hereinbefore | 0.80 g |
| Cyanine Dye P having structure shown below | 0.15 g |
| Ethyl Violet | 0.05 g |
| Methyl ethyl ketone | 5.00 g |

-continued

| | |
|---|---|
| 1-Methoxy-2-propanol | 5.00 g |
| N,N-Dimethylformamide | 10.00 g |

P

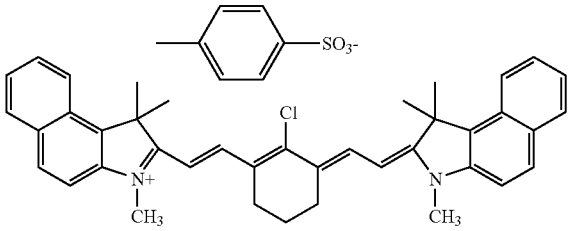

Coating solution A for upper layer having the composition shown below was coated on the lower layer obtained above by a wire bar and dried in an oven for drying set at 130° C. for 60 seconds to form an upper layer. The coating amount of the upper layer after drying was 0.4 g/m$^2$.

<Coating Solution A for Upper Layer>

| | |
|---|---|
| Compound No. 1 of Polymer Compound (II) described hereinbefore (weight average molecular weight: 8,000) | 0.90 g |
| Cyanine Dye P having structure shown above | 0.10 g |
| Methyl ethyl ketone | 10.00 g |
| 1-Methoxy-2-propanol | 10.00 g |

Thus, Photosensitive lithographic printing plate (a) was prepared.

Examples 2 to 7

Photosensitive lithographic printing plates (b) to (g) were prepared in the same manner as in Example 1 except for changing Example (1) of Polymer Compound (I) in the lower layer and Compound No. 1 of Polymer Compound (II) in the upper layer to those described in Table 5 below, respectively. Each of Compound Nos. 2 to 4 of Polymer Compound (II) has a weight average molecular weight of 8,000.

Comparative Example 1

Photosensitive lithographic printing plate (h) was prepared in the same manner as in Example 1 except for using N-phenylmaleimide/methacrylamide/methacrylic acid (45/35/20 in molar ratio) copolymer having a weight average molecular weight of 20,000 in place of Example (1) of Polymer Compound (I) in the lower layer.

Comparative Example 2

Photosensitive lithographic printing plate (i) was prepared in the same manner as in Example 1 except for using m-cresol/p-cresol (60/40) novolac resin having a weight average molecular weight of 5,000 in place of Compound No. 1 of Polymer Compound (II) in the upper layer.

Comparative Example 3

Photosensitive lithographic printing plate (j) was prepared in the same manner as in Example 1 except for not providing the upper layer.

[Evaluation of Chemical Resistance]

Photosensitive lithographic printing plates (a) to (j) were subjected to imagewise drawing (exposure) of a test pattern containing a chart having halftone dot area ratio of 1 to 99% at 175 lpi/2,400 dpi under conditions of beam output of 100% and drum rotation speed of 150 rpm using Luxel PLATESETTER T-9800HS produced by Fuji Film Co., Ltd.

Then, the exposed photosensitive lithographic printing plates were subjected to development processing and gumming treatment under conditions of developer temperature of 30° C. and developing time of 25 seconds using an automatic developing machine (Autolith PN85CE produced by AGFA) to prepare lithographic printing plates, respectively. The developer used was EP26 produced by AGFA and the gum solution used was a solution prepared by diluting FG-1 produced by Fuji Film Co., Ltd. with water in a volume ratio of 1:1. It was confirmed that all lithographic printing plates were well developed and there was no difference in the developing property.

Then, printing was conducted using the lithographic printing plates. The printing machine used was Lithlon produced by Komori Corp., the ink used was Values G produced by Dainippon Ink & Chemicals, Inc. and the dampening water used was a solution prepared by diluting IF-102 by 4% in concentration with water was used. Further, the surface of the lithographic printing plate was wiped with Multicleaner produced by Fuji Film Co., Ltd. after every 5,000 sheets printing. The printing was conducted on high-quality paper and a number of printing sheets when beginning of becoming thinner of density in the solid image area was visually confirmed was determined to evaluate the chemical resistance. As the value is large, the chemical resistance is better. The results obtained are shown in Table 5.

As can be seen from the results shown in Table 5, Photosensitive lithographic printing plates (a) to (g) within the scope of the invention exhibit the good chemical resistance. On the contrary, in Photosensitive lithographic printing plates (h) to (j), the chemical resistance is inferior.

[Evaluation of Scratch Resistance]

Each of Photosensitive lithographic printing plates (a) to (j) was frictioned 15 turns with abraser felt CS5 applied load of 250 g using a rotary abrasion tester produced by Toyo Seiki Co., Ltd.

Then, the photosensitive lithographic printing plate was subjected to the development processing in the same manner as in the evaluation of chemical resistance. With the resulting printing plate, optical densities of the abrased area and unabrased area on the plate surface were measured by a densitometer produced by Macbeth and an absolute value of the difference thereof was calculated. The results obtained are shown in Table 5. As the value is large, damage on the plate surface due to the abrasion is larger.

As can be seen from the results shown in Table 5, Photosensitive lithographic printing plates (a) to (g) within the scope of the invention exhibit the small value and good scratch resistance. On the contrary, in Photosensitive lithographic printing plates (h) and (i), the scratch resistance is inferior and in Photosensitive lithographic printing plate (j), the scratch resistance is seriously inferior.

[Evaluation of Baking]

Each of Photosensitive lithographic printing plates (a) to (j) was subjected to the exposure and development in the same manner as in the evaluation of chemical resistance to prepare a lithographic printing plate.

The lithographic printing plate was washed with water to remove the gum solution and then, BC-3 produced by Fuji Film Co., Ltd. impregnated in a sponge was coated thereon as a surface conditioning solution, followed by natural drying.

Then, the lithographic printing plate was subjected to heat treatment at 260° C. for 5 minutes by a burning oven produced by Wisconsin Oven Corp. After cooling the lithographic printing plate to room temperature, it was washed with water to remove the surface conditioning solution and then gummed by a gum coater G-800 produced by Fuji Film Co., Ltd. The gum solution used was a solution prepared by diluting GU-7 produced by Fuji Film Co., Ltd. with water in a volume ratio of 1:1.

Using the lithographic printing plate subjected to the baking treatment, the printing was conducted in the same manner as in the evaluation of chemical resistance to evaluate printing durability. The results obtained are shown in Table 5.

As can be seen from the results shown in Table 5, Photosensitive lithographic printing plates (a) to (g) within the scope of the invention exhibit the good printing durability. On the contrary, in Photosensitive lithographic printing plates (h) to (j), the printing durability like in Photosensitive lithographic printing plates (a) to (g) was not obtained.

As shown in the examples described above, the photosensitive lithographic printing plate which is excellent in both the chemical resistance and scratch resistance and provides the high printing durability by the baking treatment can be obtained according to the invention.

TABLE 5

| | Photosensitive Lithographic Printing Plate | Polymer Compound in Lower Layer | Polymer Compound in Upper Layer | Chemical Resistance ($\times 10^4$ sheets) | Density Change before and after Abrasion (Scratch Resistance) | Printing Durability after Baking Treatment ($\times 10^4$ sheets) |
|---|---|---|---|---|---|---|
| Example 1 | (a) | (1) | 1 | 7.5 | 0.00 | 16 |
| Example 2 | (b) | (2) | 1 | 6.0 | 0.01 | 14 |
| Example 3 | (c) | (3) | 2 | 7.5 | 0.01 | 15 |
| Example 4 | (d) | (4) | 1 | 8.0 | 0.00 | 16 |
| Example 5 | (e) | (5) | 1 | 6.0 | 0.01 | 14 |
| Example 6 | (f) | (2) | 3 | 6.0 | 0.00 | 14 |
| Example 7 | (g) | (2) | 4 | 8.0 | 0.00 | 17 |
| Comparative Example 1 | (h) | As described above | 1 | 4.0 | 0.02 | 9 |
| Comparative Example 2 | (i) | (1) | As described above | 3.5 | 0.03 | 8 |
| Comparative Example 3 | (j) | (1) | Not used | 3.0 | 0.05 | 4 |

What is claimed is:

1. A photosensitive lithographic printing plate precursor for infrared laser comprising in the following order: a support having a hydrophilic surface; a lower layer comprising a polymer compound obtained by polymerizing at least a polymerizable monomer represented by the following formula (I); and an upper layer comprising a polymer compound having a group represented by the following formula (II) in a side chain, (I)

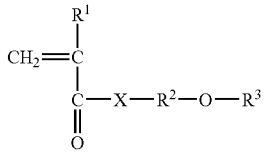

wherein $R^1$ represents a hydrogen atom or a methyl group, $R^2$ represents a methylene group or an ethylene group, $R^3$ represents a methyl group, and X represents O or NH, (II)

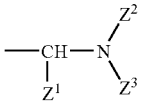

wherein $Z^1$, $Z^2$ and $Z^3$ each independently represents a hydrogen atom or a monovalent substituent composed of at least one nonmetallic atom.

2. The photosensitive lithographic printing plate according to claim 1, wherein an amount of the polymer compound obtained by polymerizing at least a polymerizable monomer represented by the formula (I) is from 10 to 99% by weight based on a total solid content of the lower layer.

3. The photosensitive lithographic printing plate according to claim 1, wherein an amount of the polymer compound obtained by polymerizing at least a polymerizable monomer represented by the formula (I) is from 20 to 95% by weight based on a total solid content of the lower layer.

4. The photosensitive lithographic printing plate according to claim 1, wherein an amount of the polymer compound having a group represented by the formula (II) in a side chain is from 10 to 99% by weight based on a total solid content of the upper layer.

5. The photosensitive lithographic printing plate according to claim 1, wherein an amount of the polymer compound having a group represented by the formula (II) in a side chain is from 20 to 95% by weight based on a total solid content of the upper layer.

6. The photosensitive lithographic printing plate according to claim 1, wherein the polymer compound obtained by polymerizing at least a polymerizable monomer represented by the formula (I) has a weight average molecular weight of from 5,000 to 500,000.

7. The photosensitive lithographic printing plate according to claim 1, wherein the polymer compound having a group represented by the formula (II) in a side chain has a weight average molecular weight of from 2,000 or more.

8. The photosensitive lithographic printing plate according to claim 1, wherein the lower layer further comprises a polymer compound soluble or swellable in an aqueous alkaline solution.

9. The photosensitive lithographic printing plate according to claim 1, wherein the upper layer further comprises a polymer compound soluble or swellable in an aqueous alkaline solution.

10. The photosensitive lithographic printing plate according to claim 1, wherein the lower layer further comprises an infrared absorbing agent.

* * * * *